US007381304B2

(12) United States Patent
Broom et al.

(10) Patent No.: US 7,381,304 B2
(45) Date of Patent: Jun. 3, 2008

(54) METHOD AND SYSTEM FOR THREADING A RUNNING PAPER WEB

(75) Inventors: Allan Broom, Coquitlam (CA); Sylvain Demers, St. Louis de France (CA); Wolfgang Drefs, Hüttlingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 356 days.

(21) Appl. No.: 10/359,880

(22) Filed: Feb. 7, 2003

(65) Prior Publication Data

US 2003/0150577 A1 Aug. 14, 2003

(30) Foreign Application Priority Data

Feb. 9, 2002 (EP) ..... 02002916

(51) Int. Cl.
*D21F 7/04* (2006.01)

(52) U.S. Cl. ..... 162/255; 162/263; 162/272; 162/286; 162/193; 162/198; 226/91

(58) Field of Classification Search ..... 162/193, 162/194, 198, 255, 263, 286; 226/91
See application file for complete search history.

(56) References Cited

U.S. PATENT DOCUMENTS 5,377,428 A * 1/1995 Clark ..... 34/446
6,193,845 B1 * 2/2001 Graf et al. ..... 162/193
6,231,722 B1 5/2001 Vestola ..... 162/198

FOREIGN PATENT DOCUMENTS

| | | |
|---|---|---|
| EP | 1 057 923 | 12/2000 |
| WO | WO 98/27275 | 6/1998 |
| WO | WO 00/60166 | 3/1999 |
| WO | WO 01/00516 | 6/2000 |

OTHER PUBLICATIONS

"Webvision® Advanced Hardware"; Mar. 2001 (4 pages).
"New Digital Break Recording Techonolgy: the key to Reducing Breaks" K.K. Hilden & D Lanthier (4 pages).
"Webvision® Digital Break Recording & Web Monitoring System" (6 pages).

* cited by examiner

*Primary Examiner*—Mark Halpern
(74) *Attorney, Agent, or Firm*—Taylor & Aust, P.C.

(57) ABSTRACT

A method for threading a running paper web from a preceding section to a following section of a paper-making or paper-finishing machine, includes the steps of: providing a threading tail of the running paper web by cutting it from the running paper web at least one of its edges; providing at least one sensing element for gaining data from at least one property of the threading tail and/or threading process; transferring the gained data into a data collecting system and/or into an analysis system; and using the data for influencing the at least one property of the threading tail and/or the threading process.

14 Claims, 2 Drawing Sheets

METHOD AND SYSTEM FOR THREADING A RUNNING PAPER WEB

This application claims priority over application number 02002916.1 filed in the European Patent Office on Feb. 9, 2002.

BACKGROUND OF THE INVENTION

1. Field of the Invention

The present invention relates to a method for threading a running paper web from a preceding section to a following section of a paper-making or paper-finishing machine. The present invention also relates to a system for threading a running paper web from a preceding section to a following section of a paper-making or paper-finishing machine, which system is fitted in connection with a preceding roll from which the running paper web is passed preferably to a pair of rolls with at least one driven roll.

2. Description of the Related Art

The threading process of a running paper web is well-known in the art and it is currently visually monitored and manually influenced. The threading process is transduced step by step, i.e. from section to section of the paper-making or paper-finishing machine. Between two sections, the threading process is started by providing a threading tail, which is usually cut from one edge zone of the running paper web. Then the threading tail is fed to and through the following section via threading elements, i.e. guiding elements (plates with air jets and/or ropes) or narrow belts. Important for a good runnability is a stable threading tail with certain elected properties, such as width or moisture, before threading and a proper draw of the threading tail to avoid breaks.

As a result of this well-known threading process, the efficiency of each threading process mainly depends on the capability and experience of the executing personnel in the paper mill. Moreover, non perfectly performed threadings can cause significant losses in machine operating speeds and runnabilities. For example, a paper-making machine producing 400 tons per day (tpd), with two breaks per day each lasting on average 20 minutes, causes over one million dollars in efficiency losses per year.

Both a method and a system for monitoring the process of separation of a running paper web in a paper-making machine is described in the U.S. Pat. No. 6,231,722 B1 (WO 98/27275 A1, DE 197 82 179 T1). The running paper web is separated from a roll and passed into a free draw, which is preferably the first draw in the paper-making machine. The factors being automatically monitored in the monitoring system are the draw difference of the web, the actual separation point, the web tension after the separation point, variations in loading pressure and moisture. The disclosed method and system are performed and optimized for a paper web running over the center roll of the press, preferably followed by a free draw of the running paper web, in particular the first free draw of the running paper web. However, the referenced patent is more or less completely silent with respect of the threading process for a running paper web.

SUMMARY OF THE INVENTION

The present invention optimizes and automates the threading process of a running paper web in making it faster, more reliable and thus more economical. The present invention also creates a possibility to diagnose and preferably predict possible causes for failures of the threading process of a running paper web.

An embodiment of the method according to the present invention includes the following steps:

- providing a threading tail of the running paper web by cutting it from the running paper web at at least one of its edges;
- providing at least one sensing element for gaining data from at least one property of the threading tail;
- transferring the gained data into a data collecting system and/or into an analysis system; and
- using the data for influencing the at least one property of the threading tail and/or the threading process.

In accordance with an embodiment of the present invention, the property of the threading tail is either manually adjusted or controlled or respectively regulated on the basis of the data. An optimized, automated threading process in the light of a good runnability and acceptable costs can thereby achieved.

The following properties of the threading tail may be sensed by the at least one sensing element in accordance with an embodiment of the present invention:

1. the existence of the threading tail at the beginning of the threading process;
2. the position of the threading tail at the beginning of the threading process;
3. the path of the threading tail during the threading process, whereat the path of the threading tail during the threading process is preferably influenced by the draw between the two sections;
4. the running stability of the threading tail during the threading process;
5. the width of the threading tail before and during the threading process, whereat the width of the threading tail before and during the threading process is preferably influenced in a range of about 50 mm to 200 mm, preferably about 100 mm to 150 mm; and
6. the quality of the cut edges of the threading tail before and during the threading process, whereat the quality of the cut edges of the threading tail before and during the threading process is preferably influenced in the manner that a minimum of breaks, preferably no breaks, appear.

The mentioned draw between two sections can be any open draw threading location such as 3-4$^{th}$ press, 4$^{th}$ press to dryer ropes, dryer to size press, dryer to breaker stack, breaker stack to coater ropes, dryer to calendar, dryer to reel, dryer to calendar ropes, calendar to reel, etc. It may also be used to control the downspeed draw of a rope system that the tail is fed into such as in a size press, coater or calendar ("Janus"). The sensing of at least two properties of the threading tail is possible. The sensed properties are advantageously compared with other process and running parameters which are monitored and/or intentionally controlled on a paper-making or paper-finishing machine, as known per se.

In accordance with another aspect of an embodiment of the present invention, the property of the threading tail is sensed by way of the Laser-Doppler method, by at least one CCD (charge coupled device) camera, by at least one high resolution digital camera with preferably both fast shutter speeds and an array of diodes and/or by infrared, by ultrasonic or by laser. Other methods known per se for sensing the process are, of course, also possible. Preferably, in connection with an embodiment of the present invention, the Laser-Doppler sensing is particularly advantageous, because the sensing element may by placed outside the paper-making or paper-finishing machine, the inside of such a machine being, as a rule, rather cramped and unsuitable for meters. If data about absolute position or angles is needed, the result may be calibrated, for example, based on laser measurement with photographs taken simultaneously. Due to new developments in the field of image processing, also at least one CCD camera or at least one high resolution digital camera with preferably both fast shutter speeds and an array of diodes are advantageous to be used for sensing.

Another property of the threading tail may be sensed by the at least one sensing element in accordance with an embodiment of the present invention: the moisture of the threading tail before and during the threading process. This property is preferably sensed by at least one moisture sensing element and influenced in a way that the moisture of the threading tail before and during the threading process ranges between 0% and 14%. Good examples for moisture ranges of two common paper qualities are: the moisture of SC paper is influenced in a range between 4% and 14%, preferably between 6% and 12% and the moisture for newsprint is influenced in a range between 0% and 10%, preferably between 1% and 8%.

The data collecting system and/or the analysis system is preferably highly sophisticated, such as equipped with at least one of a control unit and/or a regulating unit. According to a further aspect of an embodiment of the present invention, the data is used for troubleshooting purposes, such as for detecting at least one plugged threading tail cutting nozzle or improper function thereof, and/or for warning. This use is quite advantageous for monitoring the paper-making or paper-finishing machine.

The system according to an embodiment of the present invention includes at least one sensing element for sensing at least one property of the threading tail, a data collecting system and/or an analysis system, into which the results of sensing are transferred, and at least one element for influencing the at least one property of the threading tail and/or the threading process.

In accordance with an embodiment of the present invention, the sensing element for the property of the threading tail is a Laser-Doppler sensing arrangement, at least one CCD camera, at least one high resolution digital camera with preferably both fast shutter speeds and an array of diodes, an infrared, an ultrasonic or a laser arrangement and/or at least one moisture sensing element. It is common that the said arrangements and equipments are proven in the field, reliable in function, accurate in sensing and good value. The data collecting system and the analysis system according to an embodiment of the present invention are state-of-the-art. Some features of known systems are latest processor technology, usually compact portable and mobile designs, generally housed in a single interface cabinet, designed to be connected with existing millwide networks and so on.

The at least one element for influencing the at least one property of the threading tail is usually a common device, either upstream or downstream of the sensing location, in the paper-making or paper-finishing machine. Such a common device in an upstream position can be a threading tail cutting nozzle, a movable press roll or at least one hydraulic piston of it, or a drying cylinder, whereas a common device in a downstream position can be a pair of rolls with at least one driven roll, i.e. coater, size press, calendar, reel or winder.

Further, the system according to an embodiment of the present invention is combined with at least one standard PLC type control of a threading system, such as an often stand alone threading system with the smart drives. The new system can be linked with at least one inverter drive with built-in PLC functionality that allows complete data integration of the threading solution. This results in a visual and data control system that can turn the overall threading process into a completely automated process with only fault notification directing the operator. The operator can be notified how to troubleshoot the system and basically eliminates the operator from the actual process except for fault resolution. Both the data and the visual control system can remotely troubleshoot, optimize and monitor performance remotely through either a modem or via the internet both visually and data wise. This improved system optimizes and automates the threading process of a running paper web in making it faster, more reliable and thus more economical.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
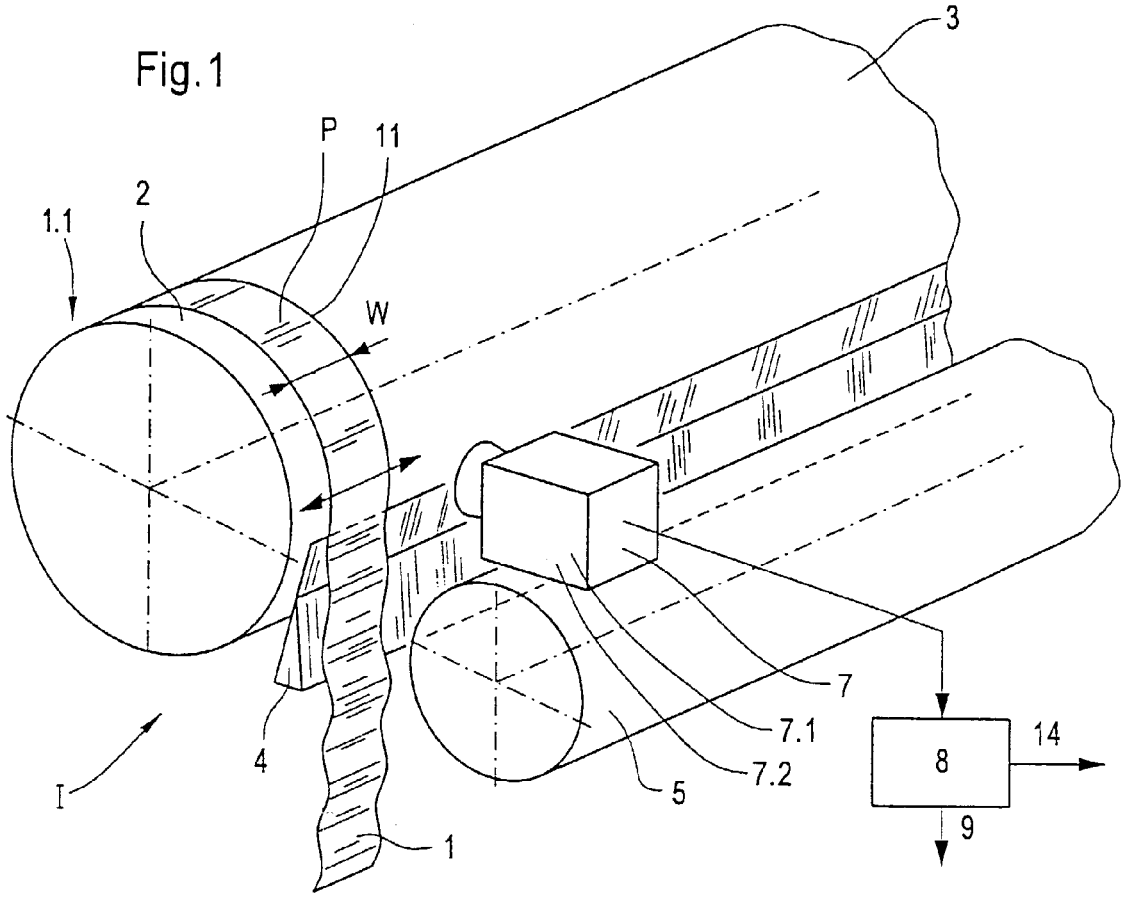
FIG. 1 is a schematic isometric view of a system in accordance with an embodiment of the present invention.
Figure 2:
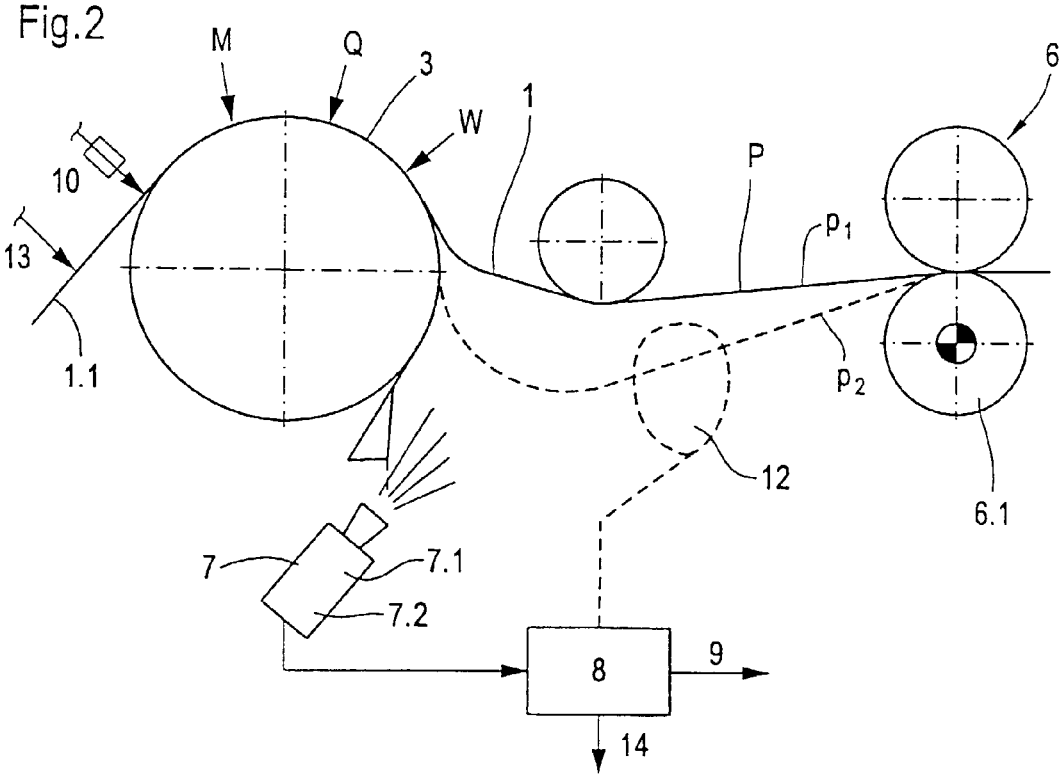
FIG. 2 is a side view of the system of FIG. 1 viewed in the direction of arrow I.

Referring now to the drawings, and more particularly to FIG. 1, threading tail 1 with width W of running paper web 1.1 (not shown) is provided to be guided to at least some extent along surface 2 of roll 3. Roll 3 can preferably be a press roll, a drying cylinder or any other kind of roll or cylinder in the paper-making or paper-finishing machine. Threading tail 1 is separated from surface 2 of roll 3 using doctor 4 and is then guided to a pulper (not shown) for recycling. In the vicinity of roll 3, there is placed at least one following roll 5 and preferably another pair of rolls 6 with at least one driven roll 6.1 (FIG. 2).

According to an embodiment of the present invention, the system includes at least one sensing element 7 for sensing at least one property P of the threading tail 1, a data collecting system and/or analysis system 8, into which the results of sensing are transferred, and at least one element 9 (arrow) for influencing the at least one property P of threading tail 1. The data collecting system and/or analysis system 8 is preferably highly sophisticated, such as equipped with at least one of a control unit and/or a regulating unit.

Sensing element 7 for property P of threading tail 1 is preferably at least one CCD camera 7.1 or at least one high resolution digital camera 7.2 with preferably both fast shutter speed and an array of diodes. Such cameras with equipments are, for example, offered by Papertech Inc., North Vancouver, BC, Canada, under the tradename WebView™, part of their WEBVISION™ Digital Web Monitoring & Break Recording System. An alternative, but not shown, sensing elements for the property of the threading tail is a Laser-Doppler sensing arrangement, an infrared, an ultrasonic or a laser arrangement and/or at least one moisture sensing element. These elements can be used alone or in combination with each other for sensing the property of the threading tail.

Data collecting system and/or analysis system 8 is, as already been mentioned, state-of-the-art. The at least one element 9 (arrow) for influencing the at lease one property of threading tail 1 has already been described above. Data collecting system and/or analysis system 8 is also coupled with at least one standard PLC type control 14 (arrow) of a threading system.

As shown in FIG. 2, a side view of FIG. 1 as viewed in direction of arrow I, the threading tail 1 is running from a preceding section, namely roll 3, to a following section, namely a pair of rolls 6 (pull stack) with at least one driven roll 6.1, of a paper-making or paper-finishing machine. The paper-making machine usually includes a reel and at least one spool.

According to an embodiment of the present invention, at least one sensing element 7 is provided for gaining data from at least one property P of threading tail 1, the gained data is transferred into data collecting system and/or analysis system 8 and the data is used for influencing, preferably manually adjusting or controlling, the at least one property P of threading tail 1. Property P of threading tail 1 can, for example, be its existence at the beginning of the threading process, its position at the beginning of the threading process, its path during the threading process, its running stability during the threading process, its width before and during the threading process and/or its quality of the cut edges before and during the threading process. All of these properties are essential to making the threading process faster, more reliable and thus more economical.

In FIG. 2, two different paths of threading tail 1 between roll 3 and the pair of rolls 6 is shown. Path $p_1$ is more or less the ideal route between the two sections 3 and 6, whereas path $p_2$ (dashed line) deviates from the ideal route. This deviation is identified by sensing element 7, such as CCD camera 7.1 or high resolution digital camera 7.2 with preferably both fast shutter speeds and an array of diodes, and the gained data transferred to data collecting and/or analysis system 8. System 8 then influences via at least one influencing element 9 (arrow) said property P, namely the path, of threading tail 1. It is obvious to someone skilled in the art, that there is too little draw in threading tail 1 between the two sections 3 and 6. Therefore, system 8 will influence the pair of rolls 6 with at least one driven 6.1 roll to increase the draw. In this case, the pair of rolls 6, 6.1 is the influencing element 9 (dashed line). The deviation of the path can obviously also be sensed by way of the Laser-Doppler method.

Another property P of the threading tail 1 can be width W before and during the threading process. Width W can also be sensed by at least one of the above-mentioned cameras, whereat the position of sensing element 7 can be different as shown in FIG. 2; it can also be above the level of threading tail 1 (FIG. 1). Width W is usually influenced in the way that it ranges of about 50 mm to 200 mm, preferably about 100 mm to 150 mm. The influencing element 9 would preferably be a threading tail cutting nozzle 10.

A third property P of threading tail 1 can be quality Q of cut edges 11 (FIG. 1) of threading tail 1 before and during the threading process. The quality Q is usually influenced in the manner that a minimum of breaks, preferably no breaks, appear and influencing element 9 would preferably be the mode, such as the operating conditions, of threading tail cutting nozzle 10.

The property of threading tail 1 can also be sensed by infrared, by ultrasonic or by laser. In the field, the most reliable and accurate method and apparatus will be used, obviously also depending on the operating conditions, such as speed, temperature or humidity.

Another important property P of threading tail 1 is its moisture M before and during the threading process. This property P of threading tail 1 is preferably sensed by at least one moisture sensing element 12 (dashed line). The method of operation has already been described above, whereat moisture M is influenced in a range between 0% and 14%. Moreover, moisture M of SC paper is influenced in a range between 4% and 14%, preferably between 6% and 12%, and moisture M for newsprint is influenced in a range between 0% and 10%, preferably between 1% and 8%. Influencing element 9 would preferably be at least one moistening nozzle 13 of a moistening unit (not shown).

The number of sensing elements 7 and 12 with corresponding influencing elements 9 should not be limited to just one sensing element, more than one sensing element can be used according to an embodiment of the present invention. In addition, the data can also be used for trouble shooting purposes, such as for detecting of at least one plugged threading tail cutting nozzle or improper function thereof, and/or for warning. Data collecting system and/or analysis system 8 is also coupled with at least one standard PLC type control of a threading system 14 (arrow).

Figure 3:
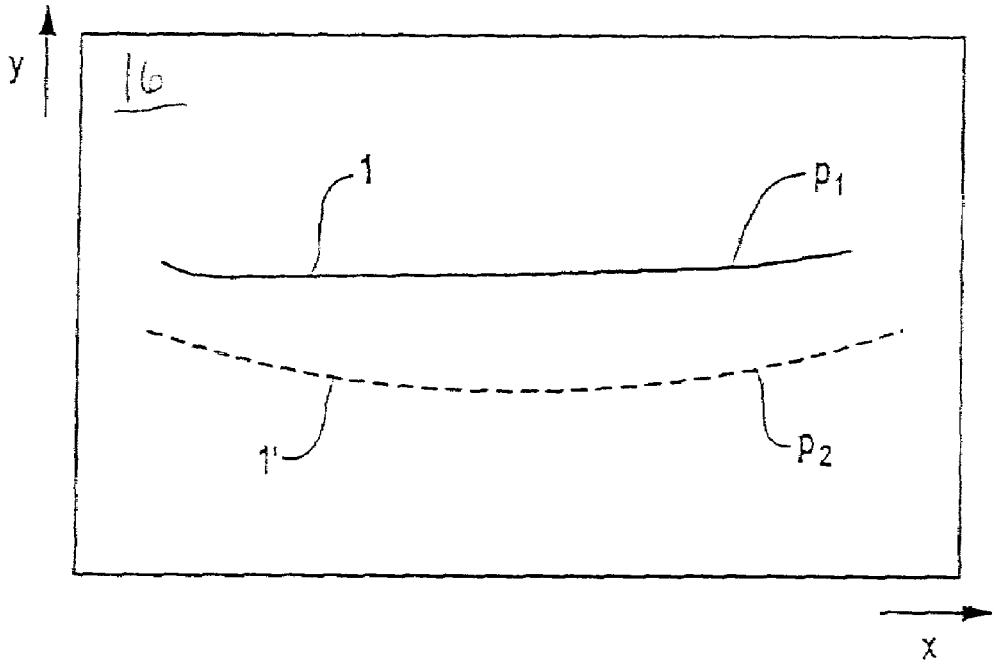
FIG. 3 is a camera window of a camera in accordance with an embodiment of the present invention.

A camera window of a camera in accordance with an embodiment of the present invention is shown in FIG. 3. With a sensing element in shape of a CCD camera, it is possible to sense the path (X/Y-position) of threading tail 1, 1' based, for example, on its color and/or brightness. A current image, e.g. path $p_2$, can be sensed and compared with a model/sample image, e.g. path $p_1$. If there is a deviation, the draw between the two sections is increased until path $p_2$ is identical with path $p_1$. Sensing element 7, including CCD camera 7.1 and high resolution digital camera 7.2, has a sensing area 16, which corresponds to the camera window of FIG. 3.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for threading a running paper web from a preceding section to a following section of a paper-making or paper-finishing machine using a threading tail, comprising:

at least one sensing element for sensing an actual path of the threading tail within a sensing area and providing output data corresponding thereto, said at least one sensing element being contactless with the threading tail, said at least one sensing element being configured for sensing a deviation of said actual path of the threading tail from an ideal path of the threading tail within said sensing area;

at least one of a data collecting system and an analysis system connected to at least one said sensing element for receiving said output data; and at least one influencing element connected to at least one of said data collecting system and said analysis system, for influencing said actual path of the threading tail by influencing a draw of the threading tail dependent on said deviation from said ideal path.

2. The system of claim 1, wherein at least one said influencing element influences said path dependent on an output from at least one of said data collecting system and said data collecting system and said analysis system.

3. The system of claim 1, wherein at least one said sensing element is a Laser-Doppler sensing arrangement.

4. The system of claim 1, wherein at least one said sensing element is at least one CCD camera.

5. The system of claim 1, wherein at least one said sensing element is at least one high resolution digital camera.

6. The system of claim 5, wherein at least one said high resolution digital camera includes both fast shutter speeds and an array of diodes.

7. The system of claim 1, wherein said sensing element is at least one of an infrared arrangement, an ultrasonic arrangement and a laser arrangement.

8. The system of claim 1, wherein the following section includes at least one driven roll, at least one said influencing element is at least one said driven roll.

9. The system of claim 1, further including at least one standard PLC type control of a threading system connected to at least one of said data collecting system and said analysis system.

10. A system for threading a running paper web from a preceding section to a following section of a paper-making or paper-finishing machine using a threading tail, which system is fitted in connection with a preceding roll from which the running paper web is passed to a pair of rolls with at least one driven roll, comprising:

at least one sensing element for sensing at least one property of the threading tail and providing output data corresponding thereto, at least one said sensing element being adapted to sense a deviation of a path of the threading tail within a sensing area from an ideal path of the threading tail within said sensing area;

at least one of a data collecting system and an analysis system connected to at least one said sensing element for receiving said data; and at least one influencing element connected to at least one of said data collecting system and said analysis system, for influencing at least one of at least one said property of the threading tail and a threading process and for influencing a draw of the threading tail dependent on said deviation.

11. A system for threading a running paper web from a preceding section to a following section of a paper-making or paper-finishing machine using a threading tail, which system is fitted in connection with a preceding roll from which the running paper web is passed to a pair of rolls with at least one driven roll, comprising:

at least one sensing element for sensing at least one property of the threading tail and providing output data corresponding thereto, at least one said sensing element being at least one moisture sensing element configured for sensing a moisture of the threading tail before a threading process;

at least one of a data collecting system and an analysis system connected to at least one said sensing element for receiving said data; and at least one influencing element connected to at least one of said data collecting system and said analysis system, for influencing said threading process dependent on said moisture.

12. The system of claim 11, wherein said at least one influencing element is configured for influencing said moisture of the threading tail.

13. The system of claim 11, wherein said at least one influencing element is at least one moistening nozzle.

14. The system of claim 11, wherein said threading process threads the threading tail from the preceding section to the following section of the paper-making or paper-finishing machine.

* * * * *